US010926124B2

(12) United States Patent
Marti

(10) Patent No.: US 10,926,124 B2
(45) Date of Patent: Feb. 23, 2021

(54) WEARABLE ANCHOR FOR A THERAPY DEVICE

(71) Applicant: Eduardo M Marti, Weston, FL (US)

(72) Inventor: Eduardo M Marti, Weston, FL (US)

( * ) Notice: Subject to any disclaimer, the term of this patent is extended or adjusted under 35 U.S.C. 154(b) by 86 days.

(21) Appl. No.: 16/183,670

(22) Filed: Nov. 7, 2018

(65) Prior Publication Data

US 2020/0086159 A1 Mar. 19, 2020

Related U.S. Application Data

(63) Continuation-in-part of application No. 16/130,953, filed on Sep. 13, 2018.

(51) Int. Cl.
*A63B 21/055* (2006.01)
*A63B 21/04* (2006.01)
(Continued)

(52) U.S. Cl.
CPC ..... *A63B 21/0557* (2013.01); *A63B 21/0442* (2013.01); *A63B 23/03508* (2013.01); *A61H 1/0237* (2013.01); *A63B 2023/006* (2013.01)

(58) Field of Classification Search
CPC ..... A63B 21/0557; A63B 21/0442; A63B 23/03508; A63B 2023/006; A63B 21/4011; A63B 21/4015; A63B 2208/0252; A63B 21/00185; A63B 21/00181; A63B 22/20; A61H 1/0237; A61H 1/0259; A61H 1/0266; A61H 1/024; A61H 2201/0157; A61H 2201/0153; A61H 2203/0456; A61H 2203/045; A61H 2205/102; A61H 2201/1664; A61H 2205/106;
(Continued)

(56) References Cited

U.S. PATENT DOCUMENTS 5,832,560 A * 11/1998 DePalma ..... A61F 13/041 16/30
6,551,221 B1 * 4/2003 Marco ..... A63B 21/0004 280/600
(Continued)

OTHER PUBLICATIONS

JAS Joint Active Systems; Knee Products; https://jointactivesystems.com/products/areas/knee/.
(Continued)

*Primary Examiner* — Garrett K Atkinson
(74) *Attorney, Agent, or Firm* — The Keys Law Firm PLLC

(57) ABSTRACT

A wearable anchor having a support base, a locking mechanism, and a securing strap and which can be used to mechanically fix a therapy device a desired position relative to a user while performing desired therapy motions. The support base defines an arcuate body suitable to be placed against the thigh of the user, with the securing strap operating to hold it against the user's thigh. The locking mechanism employs a pair of slots positioned above the support base. In this regard, the locking mechanism provides a securing structure to which the cords can be fastened to, thereby allowing the therapy device to be fixed in place without requiring that the user manually hold the therapy device in place. As such, the user can more easily perform therapy motions which require the that the therapy device be held in place, such as static progressive stretch therapy motions.

8 Claims, 9 Drawing Sheets

(51) Int. Cl.
*A63B 23/035* (2006.01)
*A63B 23/00* (2006.01)
*A61H 1/02* (2006.01)

(58) Field of Classification Search
CPC ..... A61H 2201/1671; A61H 2205/10; A61H 2201/1642; A61H 2201/1276; A61H 2201/1635
See application file for complete search history.

(56) References Cited

U.S. PATENT DOCUMENTS 7,740,566 B2 * 6/2010 Nativ ..... A63B 21/00181 482/68
8,864,632 B2 * 10/2014 Johnson ..... A63B 22/20 482/79
10,232,213 B1 * 3/2019 Smith, Jr. ..... A63B 23/1281
10,576,620 B1 * 3/2020 Chou ..... B25J 9/0006
2006/0040807 A1 * 2/2006 Miller ..... A63B 21/4015 482/124
2008/0119765 A1 * 5/2008 Meckel ..... A61H 1/024 601/34
2009/0107533 A1 * 4/2009 Nativ ..... A61H 3/04 135/67
2015/0190668 A1 * 7/2015 Ferdinandsen, II . A63B 21/012 482/93
2015/0343261 A1 * 12/2015 Liptack ..... A63B 21/0004 482/80
2018/0290002 A1 * 10/2018 Colangelo ..... A63B 21/00043
2020/0197743 A1 * 6/2020 Biele ..... A63B 23/03541
2020/0261758 A1 * 8/2020 Souffrain ..... A63B 23/0216

OTHER PUBLICATIONS

Lantz Medical; Stat-A-Dyne Knee; https://www.lantzmedical.com/stat-a-dyne-tm-knee.
Ortho Innovations; Mackie Knee Brace; http://www.orthoinnovations.com/mackieKnee.html.
The Medcom Group Ltd, Ezmend Knee Motion Device; https://www.medcomgroup.com/ezmend-knee-motion-device.
The Rehab Store, Sammons Preston Rigid Leg Lifter; https://www.rehab-store.com/p-sammons-preston-rigid-leg-lifter.html.

* cited by examiner

WEARABLE ANCHOR FOR A THERAPY DEVICE

CROSS REFERENCE TO RELATED APPLICATIONS

This application is a continuation in part of, claims the benefit of, and incorporates by reference co-pending U.S. patent application Ser. No. 16/130,953 filed Sep. 13, 2018.

BACKGROUND OF THE INVENTION

Field of the Invention

This invention relates to an anchor for use with a therapy device which allows such a therapy device or similar device to be fixed in a desired position relative to a user without requiring that application of ongoing force from the user.

Description of the Prior Art

Following acute lower limb injuries and/or surgery, it is common for patients to suffer from mechanical limitations in and around their joints. In order to help a patient regain strength and range of motion ("ROM") to the affected joints, patients are generally required to participate some form of therapy during the recovery process. Such therapy may involve attending clinician (e.g., physician, physical therapist) directed sessions at a clinic or medical facility. Unfortunately, often times therapy sessions are cut short prior to the completion of the recovery process. This can be due to a variety of reasons, such as limited treatment sessions approved by insurance companies, lack of transportation, inclement weather, illness, or inability to take days off from work to attend therapy sessions at the clinic.

In instances wherein therapy sessions are cut short, at-home adjunct devices may be used by a patient at home to optimize rehabilitation outcomes and to avoid scar tissue formation in order to eliminate the need for extended rehabilitation at a physical therapy ("PT") clinic or for manipulation under anesthesia ("MUA"). Indeed, it is well established that clinicians often prescribe the use of various rehabilitation (or rehab) devices to the injured patient to allow a patient to continue work to restore their health without having to attend frequent in-clinic therapy sessions. This practice has led to the development of many different types of devices designed to help augment rehabilitation efforts and patients that wish to continue to progress without the benefit of an in-clinic professional therapist, use these types of devices.

Adjunct at-home devices available today for knee and hip therapy cover a broad spectrum of options. Nonetheless, there are two types of motions that are viable, and typically, these devices generally only cover one or the other type of motion. The first type, passive motion, is a motion created by an outside force action on the persons limb/joint. The second type, active motion, is a motion in which the patient is supplying the force to move the affected limb on their own. In instances wherein a patient is working in-clinic with a clinician, the clinician typically provides both types of motions when they provide therapy to a patient. For example, the clinician can hold a patient's limb at a desired flexed position, and then asked the patient to activate their muscles to try to move their limb while the therapist resists (active resistance). A clinician may also slowly allow the patient to move the limb as the clinician adjusts the tension, allowing movement to occur (isotonic). A clinician may also allow the patient to move the limb by pushing as hard as they can while providing sufficient resistance to allow movement to occur at a set speed (isokinetic). A clinician may also have the patient push as hard as they can for 10 seconds then release the resistance and allow the patient to move to a different angle and repeat the same 10 second routine (isometric). A clinician can also have the patient try to lightly resist the motion the clinician provides as the clinician moves the limb through a range of motion (eccentric). In any event, the clinician is trained to evaluate the dynamics of movement that each patient exhibits and perform the best or combination of the best motion therapies that can improve joint function.

Attempts have been made to provide adjunct at-home devices which meet the needs of patients. Many of the devices for home use for ankles and knees are portable cycling devices. These devices have stands with foot pedals. The patient simply mimics riding a bicycle while sitting on a chair. Some of devices are motorized so that the patient can just relax and let the device rotate and move the limb. This type would be considered passive. The same bicycle type may have a resistance capability whereby a frictional force can make the patient provide more muscle power to turn the pedals, providing active resistance. This is also a type of isotonic motion.

Another class of devices is passive type equipment. Devices used after knee arthroscopic or knee implant surgery are known as continuous passive motion ("CPM") devices. These devices have electronic controllers that can be programmed to move the limb through a set ROM at a set speed and with a defined force level. These devices are rented by the day are generally utilized for about 14-21 days. Unfortunately, many insurance companies will not pay for a CPM device.

There are a several devices that provide a track with a sliding platform that allow the patient to flex and extend the leg using the track as a guided path and then by turning the track sideways, do hip abduction exercises. This type of device offers little or no resistance and its primary function is to keep joint mobility or maintain ROM between therapy sessions. The slider type device requires the patient to supply the energy to move the limb. This would be considered a low force active exerciser.

Other types of devices are the standard fitness-gym devices (e.g. leg extension machines) that use weights to provide resistance to the patient's limbs. These types of devices are external devices that are not used to rehabilitate the patients injured knee joint at home and they do not provide a feedback loop to the patient.

Another type of activity which may be employed during a recovery process is stretching. In many cases, clinicians may direct the utilization of mechanical stretching devices as part of a stretching program. Generally, mechanical stretching devices may be categorized as either dynamic low-load prolonged duration stretch devices ("LLPS") or static progressive ("SP") (i.e., splint) stretch devices. LLPS devices permit resisted active and passive motion (elastic traction) within a limited range. SP stretch devices hold the joint in a set position but allow for manual modification of the joint angle (inelastic traction).

In light of the normal therapy protocols that are implemented by a clinician, there remains a need for an adjunct at-home therapy device that is able to facilitate the performance of rehabilitation exercises similar to those used by a clinician as they pertain to combined types of motions, active and passive, as well as those motions described as active resistive (isotonic), and active/rest/passive (contract relax therapy). There also remains a need for an adjunct at-home therapy device that can provide for both dynamic and static progressive stretch therapy. And to enhance the capability of such an adjunct at-home therapy device, there is a need for an anchor device which allows for such an adjunct at-home device to be selectively fixed in a desired location relative to a user's body so as to enable the performance of a wider variety of motions, such as progressive stretching type motions, without forcing the user to have to hold the adjunct at-home device in place during the motion(s).

SUMMARY OF THE INVENTION

The present disclosure provides for a wearable anchor for a therapy device, such as a slidable portable lower limb therapy device, or any similar device which employs elongated cords to allow a user use their upper body to control or manipulate its movement. The wearable anchor for a therapy device allows such a therapy device to be fixed in a desired position relative to a user, without requiring the user to manually hold it, while the user performs desired therapy motions.

The wearable anchor for a therapy device comprises: a support frame having a bottom surface, wherein the support frame is configured by way of the size and contour of its arcuate body to be placed against a body of a user with the bottom surface contacting the body of the user and configured by way of an attachable securing strap to be secured to the body of the user; and a locking component integral with said support frame and configured by way of a tapered slot in a vertically extended slot member to receive and selectively secure a cord.

DETAILED DESCRIPTION OF THE INVENTION

Figure 1:
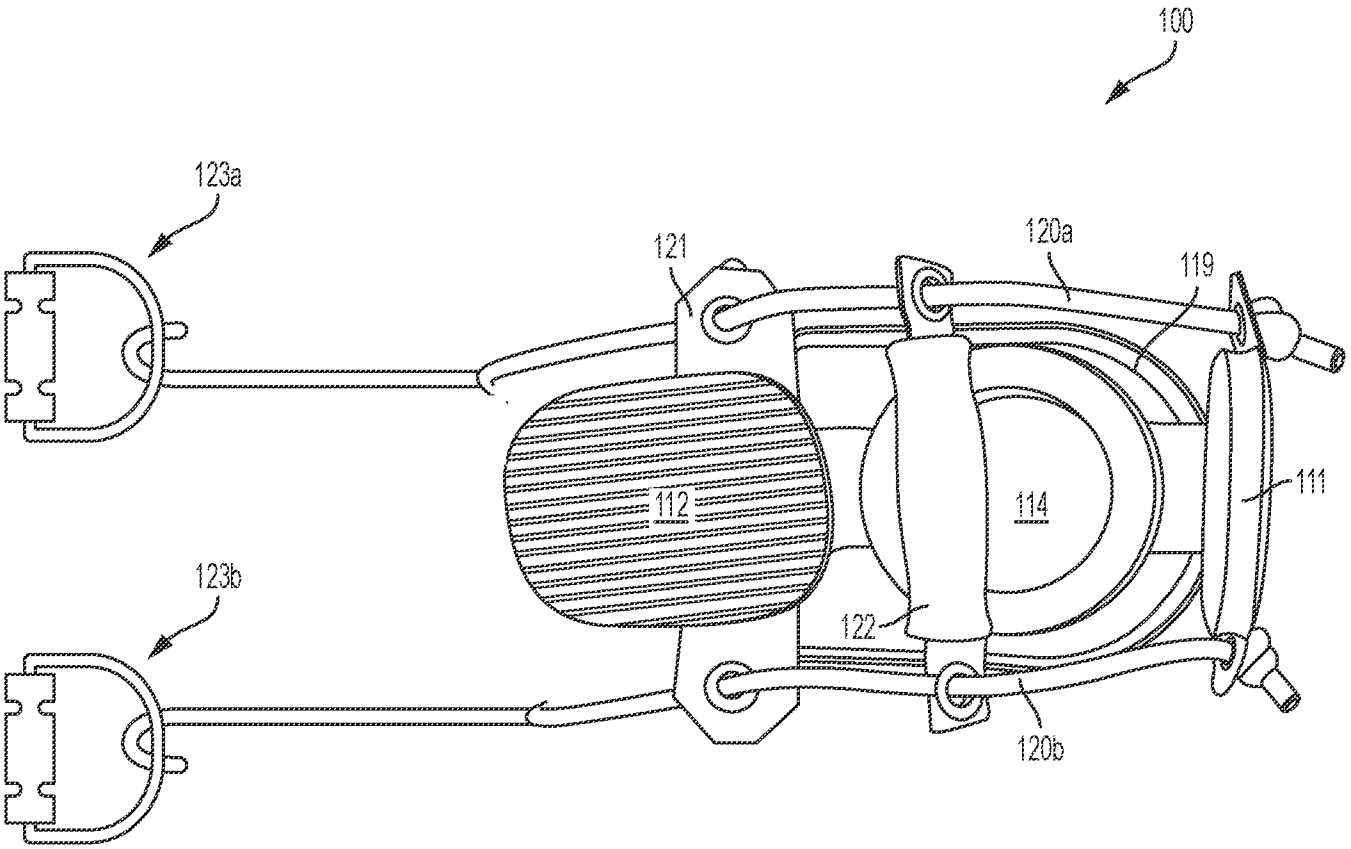
FIG. 1 is a top plan view of a portable lower limb therapy device built in accordance with a front handle embodiment of the present invention.

Described herein is a wearable anchor which can be used to mechanically fix a therapy device, such as a portable lower limb therapy device, in a desired position relative to a user so as to enable the performance of static progressive stretch therapy motions without requiring that the user (or another person) manually hold the therapy device in place.

Referring now to the drawings and, in particular, FIGS. 1, 2, 3, and 4, a portable lower limb therapy device 100 built in accordance with a front handle embodiment is shown having a support base and a pulley system. The support base includes a slider 110 having a platform member 112 fixably mounted on top of it and a back panel 111 extending up from a location at or behind the proximal edge 113*a* (i.e., on the opposite side of the proximal edge 113*a* as the distal edge 113*b*). The support base has a proximal edge 113*a* and a distal edge 113*b*, which may be formed as the rear and front edges of the slider 110, respectively.

The slider 110 may define a rigid, slightly curved member having a smooth bottom surface that limits friction and allows it slide and glide when placed on other surfaces. The slider 110 may be constructed of hard plastic and the back panel 111, platform member 112, heel cup 114, and foot pad 114 may be constructed out of a substantially firm yet pliable foam.

Figure 3:
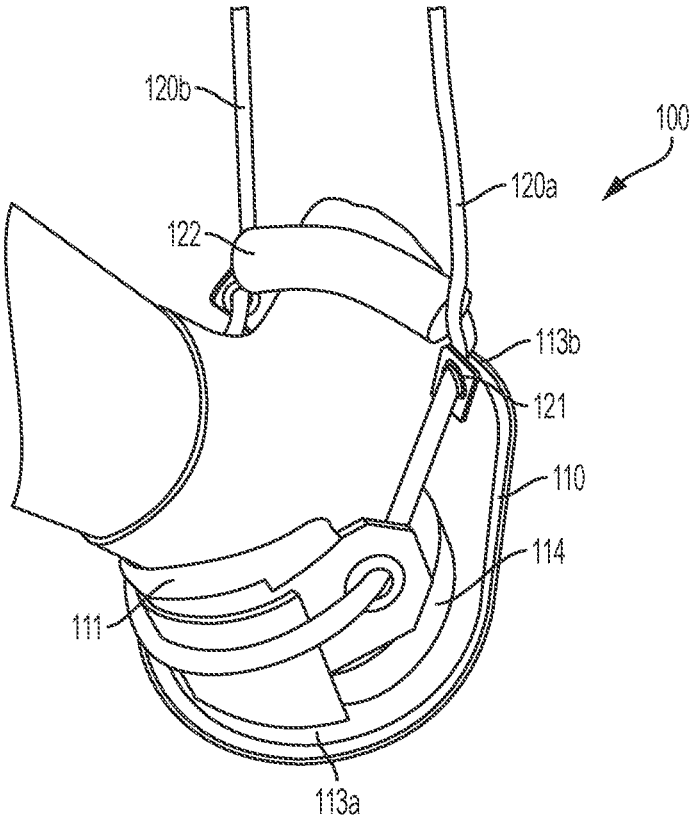
FIG. 3 is a side elevational view of a portable lower limb therapy device built in accordance with a front handle embodiment of the present invention, shown with a patient's foot in placed therein.

The platform member 112 may be defined by an elongated planar pad and is positioned adjacent to the distal edge 113*b*. The platform member 112, which may extend beyond the distal edge 113*b*, is movable relative to the slider 110 so as to be able to flex between an elevated position relative to the slider 110 and a planar position relative to the slider 110. It is appreciated that the platform member 112 being in the elevated position, forming a slope that rises as it moves away from the proximal edge 113*a*, defines the flexed configuration of the support base while the platform member 112 being in the planar position, sitting in horizontal alignment with the platform member 112, defines the relaxed configuration of the support base. It is further appreciated that the platform member 112 being in the elevated position enables the placement of a foot of a user in a therapeutic diagonal position relative to the slider 110, with the heel of the foot resting in the heel cup 114 and the foot extending up therefrom onto a substantially diagonally oriented platform member 112, as illustrated in FIG. 3.

The back panel 111 may be defined an planar pad and may be attached to and extend up from the slider 110.

The support base may additionally include a heel cup 114 positioned over the top surface of the slider 111 and adjacent to the proximal edge 113*b*. The heel cup 114 may be defined as a circular padded body having a raised perimeter edge and a depressed center portion. It is appreciated that the heel cup 114 configures the support base to be able to receive a heel of a user's foot and allow the heel to rest therein with the foot pointing towards the distal edge 113*b*.

In an alternate embodiment, the platform member 112 and heel cup 114 may be formed as a unitary body.

The pulley system defines a closed force transfer system and includes two cord members 120*a* 120*b*, a support member 121, a cross member 122, and two handles 123*a*, 123*b*, with a right handle 123*a* adjacent to the right side of the portable lower limb therapy device 100 and a left right handle 123*a* adjacent to the left side thereof. A right cord member 120*a* connects to and extends from the back panel 111 on the right side and a left cord member 120*b* connects to and extends from the back panel 111 on the left side. The right cord member 120*a* then passes through an aperture positioned on the right side of the cross member 122, then through an aperture positioned on the right side of the support member 121, finally connecting to the right handle 123*a*. The left cord member 120*b* then passes through an aperture positioned on the left side of the cross member 122, then through an aperture positioned on the left side of the support member 121, finally connecting to the left handle 123*b*. In this regard, the back panel 111 connects the two cord members 120*a*, 120*b* and allows force that is simultaneously applied to each of the handles 123*a*, 123*b* to act together to raise, lower, or otherwise manipulate the support base solely through the application of force on the handles.

The handles 123*a*, 123*b* may be constructed of or otherwise include foam. The handles 123*a*, 123*b* may be defined by a substantially cylindrical handle portion with a foam surface and a web type strap, with the web type strap connecting to the cord members 120*a*, 120*b* and to the handle portion to improve durability without sacrificing comfort.

The support member 121 defines a mechanical connector integrated with the foot pad 114, with a connection portion positioned on the right side of the foot pad 114 and a connection portion positioned on the left side of the foot pad 114. Each connection portion may include an aperture therein so as to configure it to allow the cord members 120*a*, 120*b* to pass through it.

The support member 121 may define a molded or web type strap that is attached to the underneath of the foot pad 114, above the platform member 112, with a portion extending beyond the foot pad 114 on both the right and left side so as to form the connection portions. The connection portions may include grommets integrated with the apertures therein. In an alternate embodiment, the support member 121 may be defined solely by two connection portions extending from either side of the foot pad 114.

The cross member 122 is positioned sufficiently above the heel cup 114 to allow the foot of a user that is placed on the platform member 112 with the heel in the heel cup 114 to slide underneath the cross member 122. The cross member 122 may be defined by a substantially cylindrical handle portion with a foam surface.

Each cord member 120*a*, 120*b* may define an elongated, continuous line that may be constructed of a rope, strap, tubing, or cable. The cord members 120*a*, 120*b* may be of an elastic material or a rigid material.

The back panel 111 may include grommets integral with the apertures through which the cord members 120*a*, 120*b* pass prior to be secured thereto.

It is contemplated that a user having their foot positioned in the may exert mechanical force on the lower limb therapy device 100 with their upper body (as passive motion) by grabbing either the handles 123*a*, 123*b* or the cross member 122. In this regard, the lower limb therapy device 100 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 100 is not on a track and can move in any direction, circumduction an available therapy motion option). Indeed, the pulley system enables a user to control the motion and the speed at which the lower limb moves as it is being flexed and extended thru various planes.

Moreover, because of the slider 110 can move on substantially any type of smooth surface, the lower limb therapy device 100 provides a means to support the weight of a user's lower limb and allow the limb to slide and glide even on uneven surfaces as a bed or therapy table.

Referring now to FIGS. 5, 6, 7, 8, 9, and 10, a portable lower limb therapy device 200 built in accordance with a back handle embodiment is shown having a support base and a pulley system. The support base includes a slider 210 having a platform member 212 fixably mounted on top of it and a heel panel 211 positioned behind the platform member 212 extending from it. The platform member 212 may include a proximal portion 212*a* and a distal portion 212*b*. The heel panel 211 may be attached to the slider 210 so as to extend from the rear end of the slider 210. The pulley system includes a cord member 220, a support member 221, a cross member 222, and two handles 223, with one of the handles adjacent to the right side of the portable lower limb therapy device 200 and the other adjacent to the left side thereof.

The slider 210 may define a rigid, slightly curved member having a smooth bottom surface that limits friction and allows it slide and glide when placed on other surfaces. The platform member 212 may define a planar member and may be attached to the slider 210 so as to be raised above the top surface of the slider 210, leaving a hollow space between the bottom surface of the platform member 212 and top surface of the slider 210. The platform member 212 additionally includes a central aperture. It is appreciated that the central aperture in the platform member 212, and the hollow space between the bottom surface of the platform member 212 and top surface of the slider 210, configure the platform member 212 to be able to receive a heel of a user's foot and allow the heel to rest therein with the foot pointing towards the distal portion 212*b*.

Figure 2:
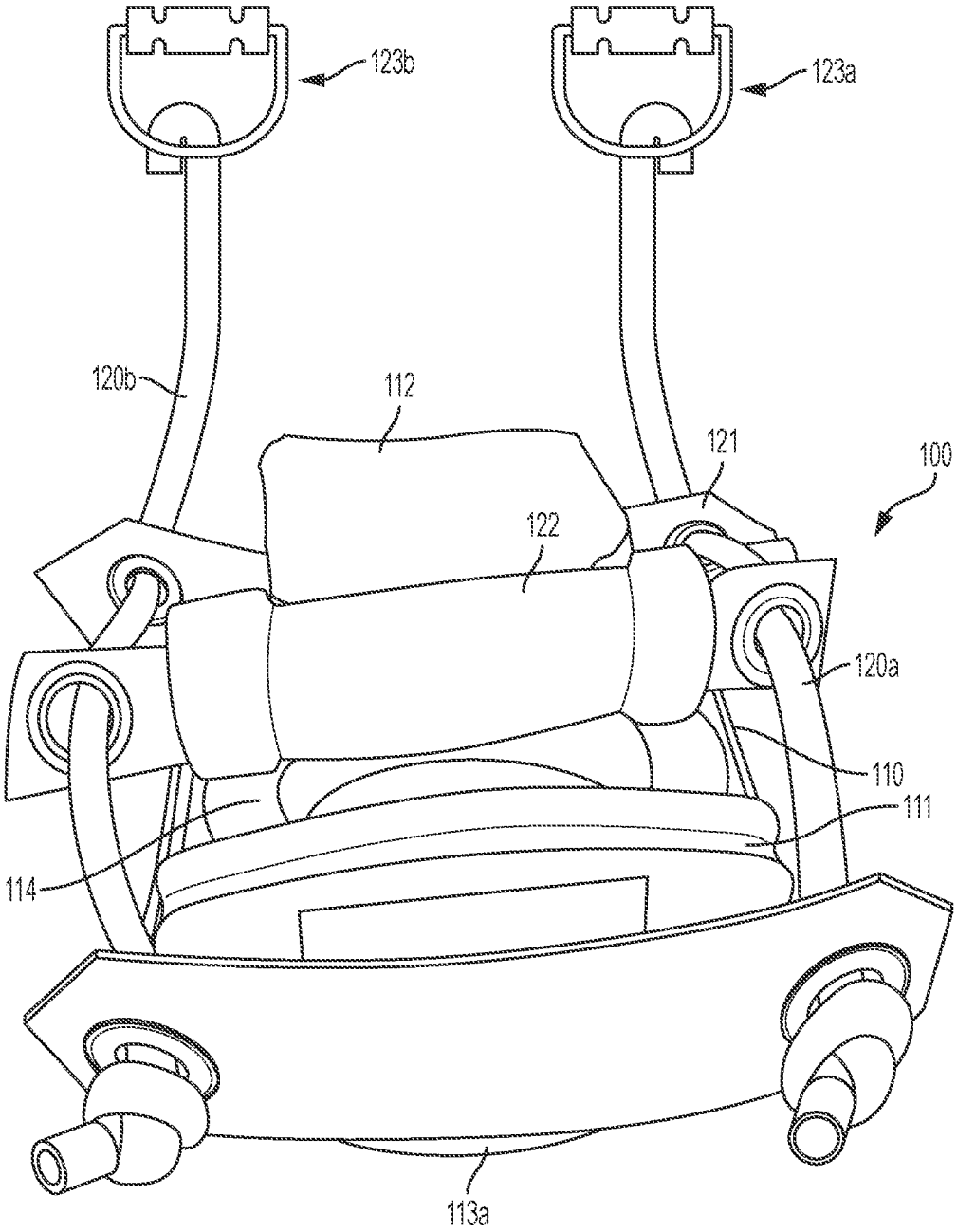
FIG. 2 is a rear perspective view of a portable lower limb therapy device built in accordance with a front handle embodiment of the present invention.
Figure 4:
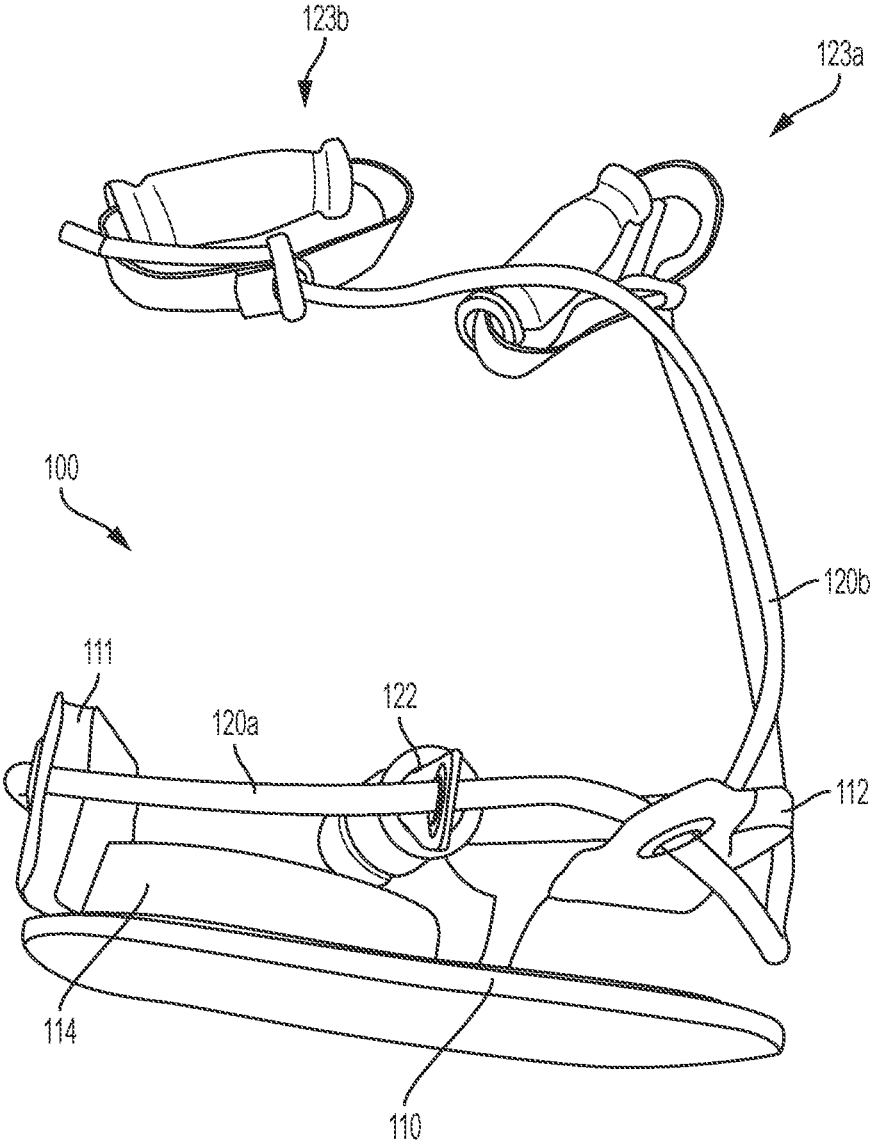
FIG. 4 is a side perspective view of a portable lower limb therapy device built in accordance with a front handle embodiment of the present invention.
Figure 5:
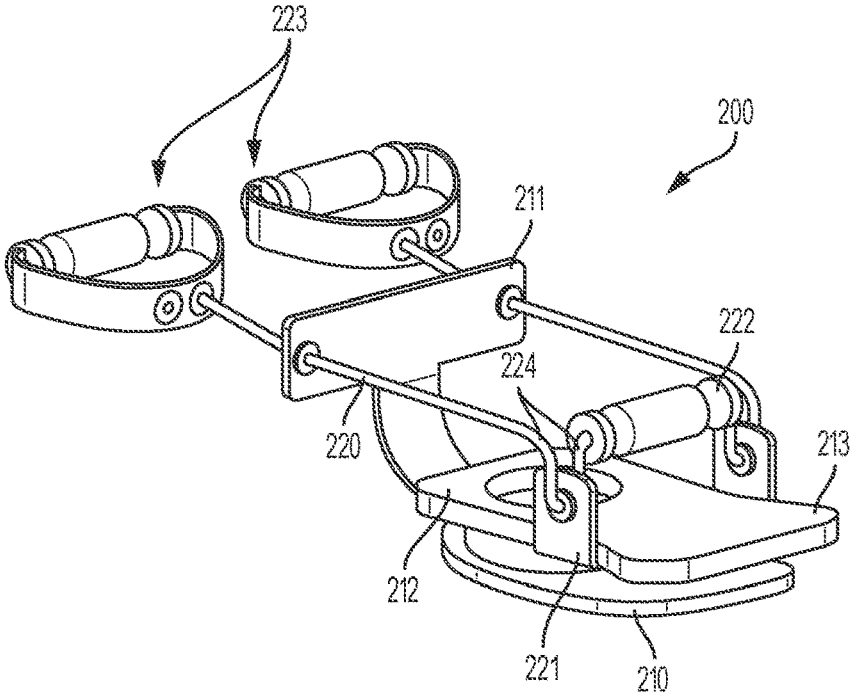
FIG. 5 is a top plan view of a portable lower limb therapy device built in accordance with a back handle embodiment of the present invention with a platform member in a relaxed configuration.
Figure 6:
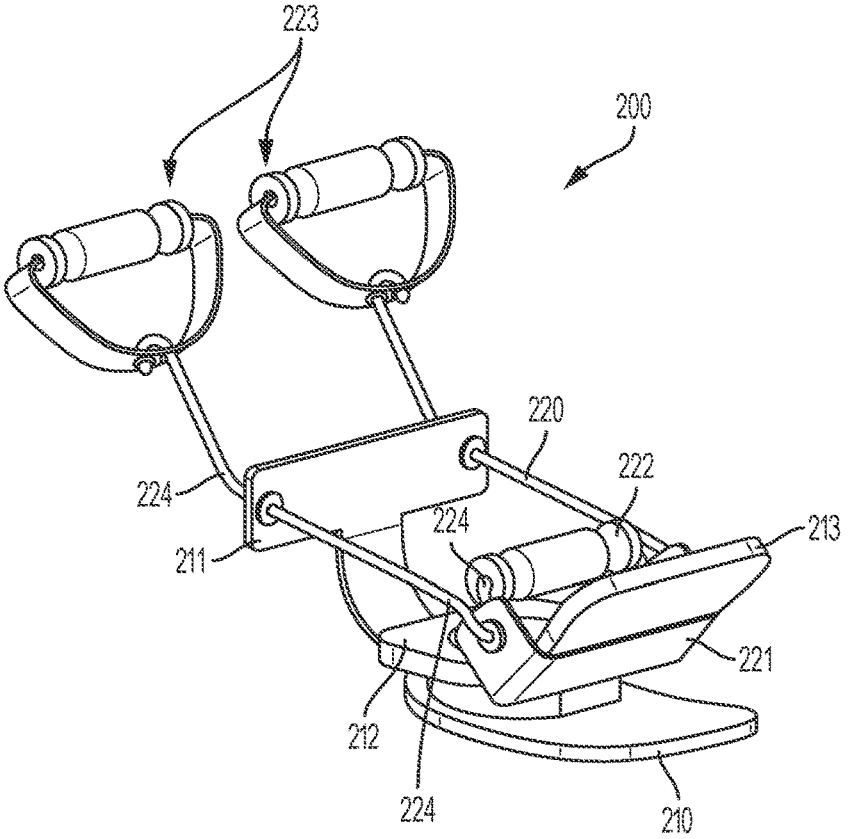
FIG. 6 is a side perspective view of a portable lower limb therapy device built in accordance with a back handle embodiment of the present invention with a platform member in a partially flexed configuration.
Figure 7:
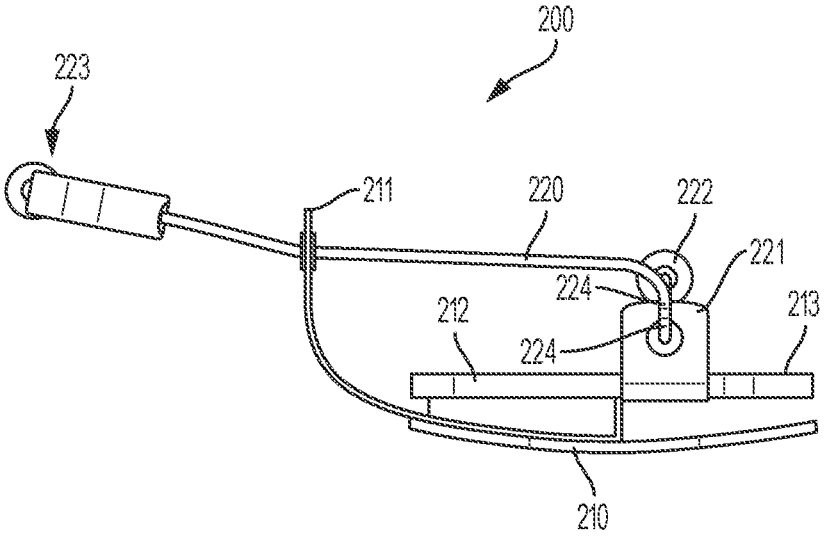
FIG. 7 is a side elevational view of a portable lower limb therapy device built in accordance with a back handle embodiment of the present invention with a platform member in a relaxed configuration.
Figure 8:
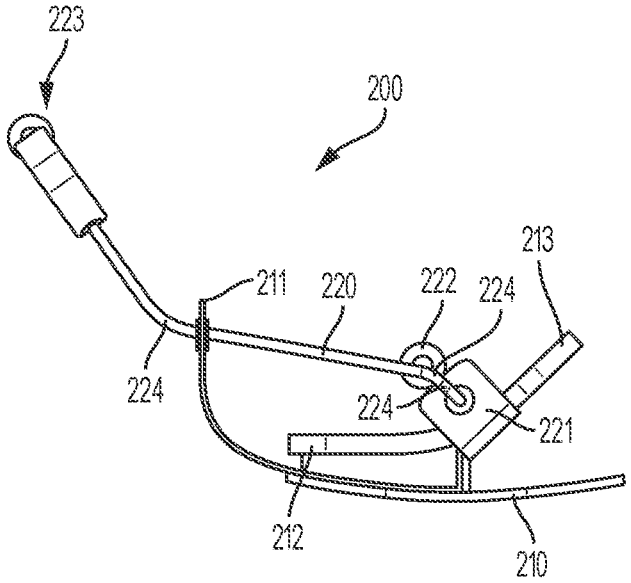
FIG. 8 is a side elevational view of a portable lower limb therapy device built in accordance with a back handle embodiment of the present invention with a platform member in a partially flexed configuration.
Figure 9:
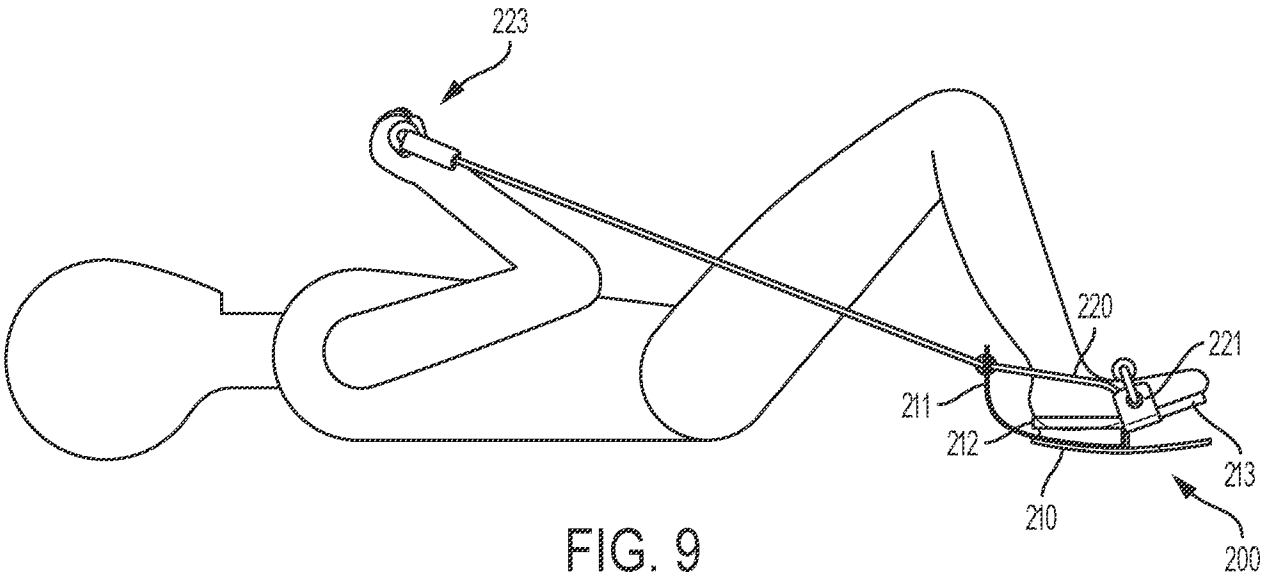
FIG. 9 is a side elevational view of a portable lower limb therapy device built in accordance with a back handle embodiment of the present invention with a platform member in a partially flexed configuration, shown with a patient's foot in place therein.
Figure 10:
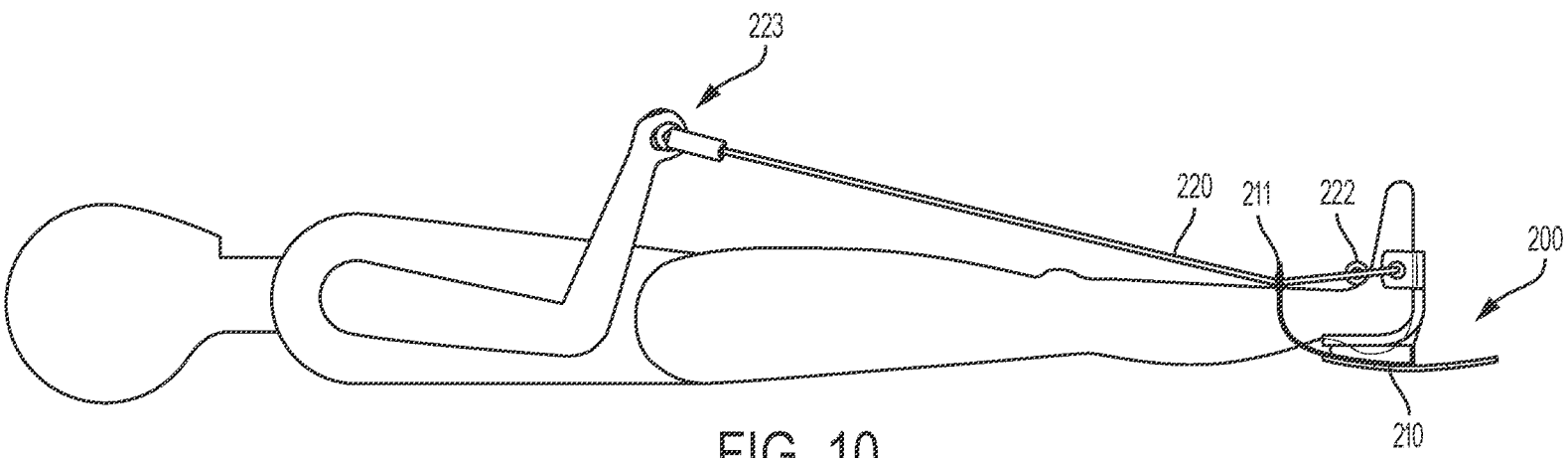
FIG. 10 is a side elevational view of a portable lower limb therapy device built in accordance with a back handle embodiment of the present invention with a platform member in a fully flexed configuration, shown with a patient's foot in placed therein.
Figure 11:
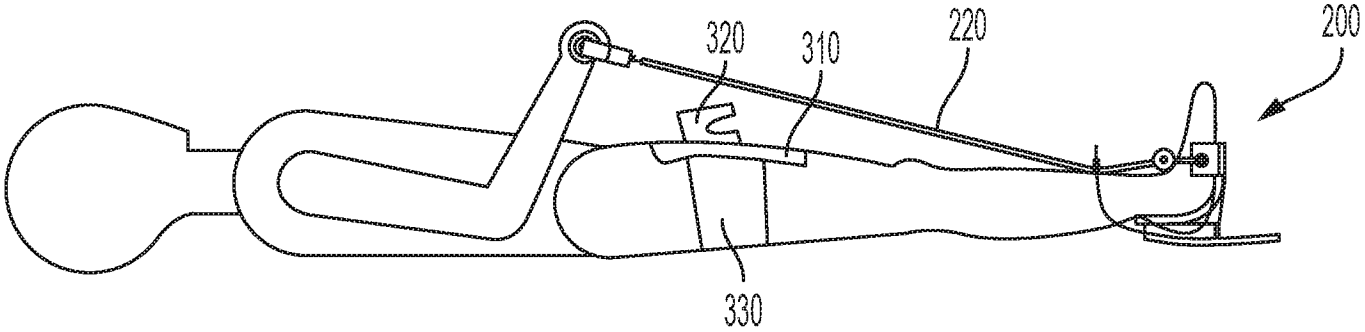
FIG. 11 is a side elevational view of a wearable anchor for a therapy device built in accordance the present invention, shown on a patient's leg along with a back handle embodiment of a portable lower limb therapy device on the patient's foot.
Figure 12:
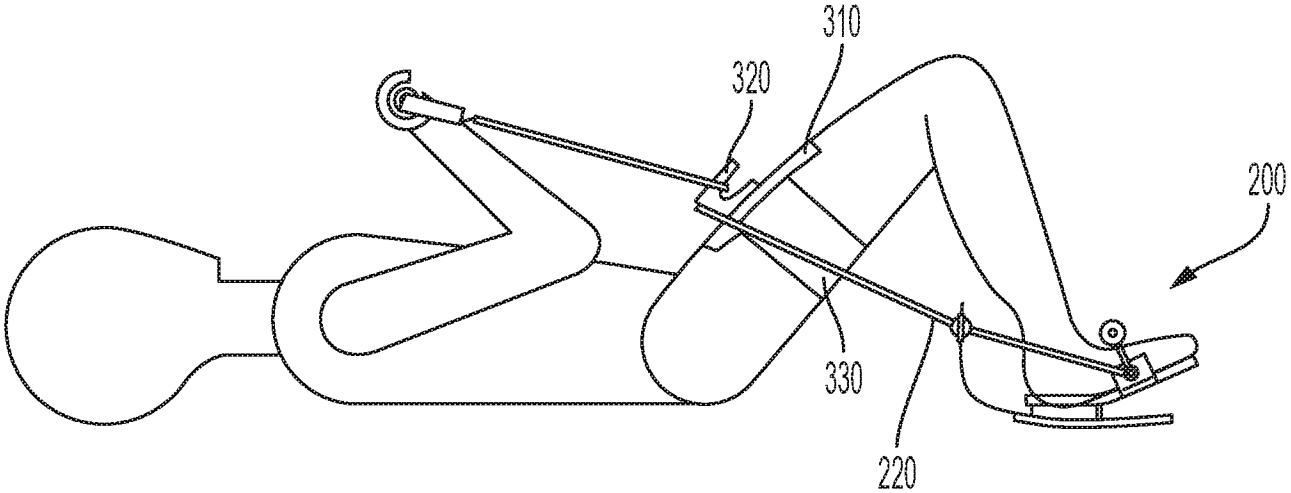
FIG. 12 is a side elevational view of a wearable anchor for a therapy device built in accordance the present invention, shown on a patient's leg along with the cord member of a back handle embodiment of a portable lower limb therapy device that is on the patient's foot fastened therein.
Figure 13:
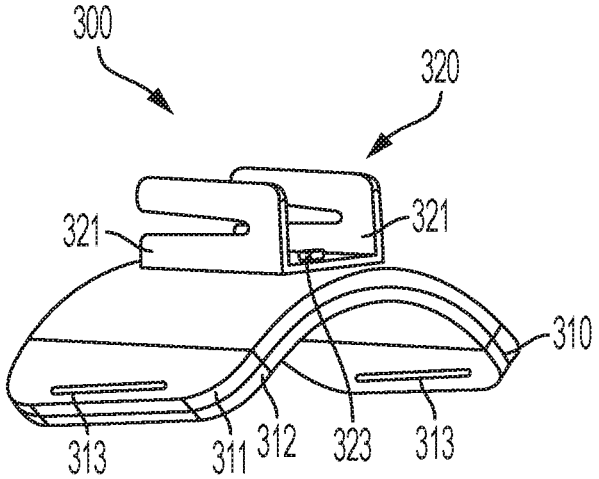
FIG. 13 is a side perspective view of a wearable anchor for a therapy device built in accordance the present invention.
Figure 14:
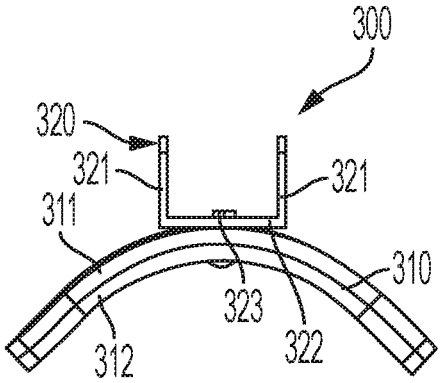
FIG. 14 is a front elevational view of a wearable anchor for a therapy device built in accordance the present invention.
Figure 15:
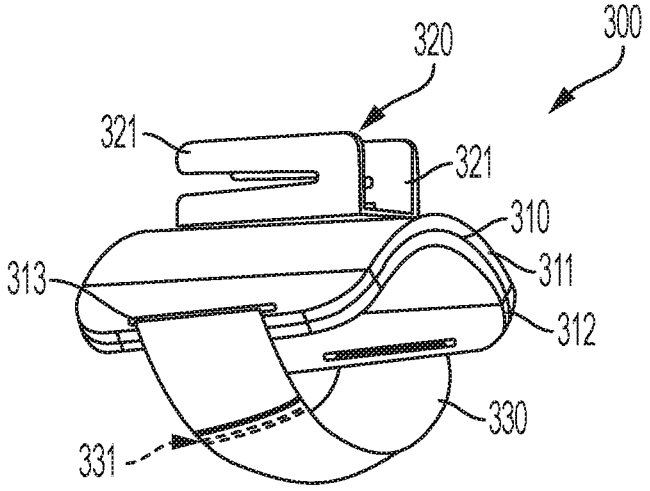
FIG. 15 is a side perspective view of a wearable anchor for a therapy device built in accordance the present invention, shown with a securing strap.
Figure 16:
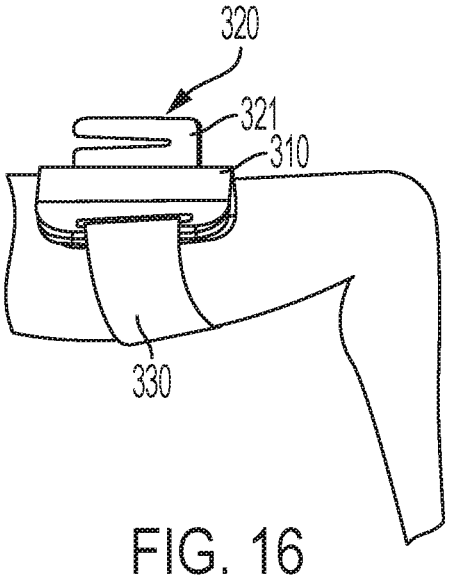
FIG. 16 is a side elevational view of a wearable anchor for a therapy device built in accordance the present invention, shown with a strap on a patient's leg.

The distal portion 212*b* forms the front edge of the platform member 212 and is movable relative to the platform member 212 so as to be able to flex between an elevated position relative to the platform member 212, as illustrated in FIGS. 2, 4, and 6, and a planar position relative to the platform member 212, as illustrated in FIGS. 1, 3, and 5. It is appreciated that the distal portion 212*b* being in the elevated position, sitting diagonally relative to the platform member 212, defines the flexed configuration of the platform member 212 while the distal portion 212*b* being in the planar position, sitting in horizontal alignment with the platform member 212, defines the relaxed configuration of the platform member 212. It is further appreciated that the distal portion 212*b* being in the elevated position enables the placement of a foot of a user in a diagonal position relative to the platform member 212 with the heel of the foot resting in the central aperture and the foot extending up therefrom onto the diagonally oriented distal portion 212*b*, as illustrated in FIG. 6.

It is contemplated that the platform member 212, including the distal portion 212*b*, may be formed of a single, unitary structure that constructed of a flexible material so as to allow for the platform member 212 to bend. In alternative embodiments, the platform member 212 may include a flexible transverse portion that allows the platform member 212 to bend or the platform member 212 may be formed from two discrete structures connected by a hinge joint.

It is contemplated that the distal portion 212*b* being wider than the rest of the platform member 212 may configure the distal portion 212*b* to receive and support portions of a user's foot having a greater width than the heel.

The slider 210 and heel panel 211 may be constructed of hard plastic and the platform member 212 may be constructed out of a substantially firm foam that can still bend when subjected to manual force in the manner described below.

The pulley system defines a closed force transfer system, arranged with the cord member 220 extending from the rear handle 223 on the right side of the portable lower limb therapy device 200, through an aperture in the heel panel 211 positioned on the right side thereof, then through an aperture in the support member 221 positioned on the right side thereof, then through the cross member 222 entering on the right side and exiting on the left side of the portable lower limb therapy device 200, then through an aperture in the support member 221 positioned on the left side thereof, through an aperture in the heel panel 211 positioned on the left side thereof and finally connecting to the rear handle 223 on the left side.

The handles 223 are each positioned behind the heel panel 211, and may be constructed of or otherwise include foam. The handles 223 may be defined by a substantially cylindrical handle portion with a foam surface and a web type strap, with the web type strap connecting to the cord member 220 and to the handle portion to improve durability without sacrificing comfort.

The support member 221 defines a mechanical connector integrated with the platform member 212, with a connection portion positioned on the right side of the platform member 212 and a connection portion positioned on the left side of the platform member 212. Each connection portion may include an aperture therein so as to configure it to allow the cord member 220 to pass through it. In addition, the support member 221 may be positioned further from the forward edge of the platform member 212 than the distal portion 212*b*.

The support member 221 may define a molded or web type strap that is attached to the bottom of the platform member 212, with a portion extending beyond the platform member 212 on both the right and left side so as to form the connection portions. The connection portions may include grommets integrated with the apertures therein. In an alternate embodiment, the support member 221 may be defined solely by two connection portions extending from either side of the platform member 212.

The cross member 222 is positioned sufficiently above the platform member 212 to allow the foot of a user that is resting on the platform member 212 to slide underneath the cross member 222. The cross member 222 may be defined by a substantially cylindrical handle portion with a foam surface. The cross member 222 may be positioned directly above the support member 221 such that the cord member 220 travels vertically from the support member 221 on either side of the cross member 222 into the cross member 222 (when the platform member 212 is in the planar position).

Notably, because the cord member 220 extends from the rear handle 223 on each side of the, to and through the support member 221 on either side of the platform member 212, the pulley system is configured to transfer force applied behind the heel panel 211 to the platform member 212. Similarly, because the cord member 220 connects on either end to one of the handles 223, passes through the support member 221 on either side of the platform member 212, and passes through the cross member 222, the pulley system is configured to transfer force applied above a user's foot positioned on top of the platform member 212 to the platform member 212.

The pulley system may also include a plurality of rigid shafts 224 through which the cord member 220 passes. It is contemplated that the rigid shafts 224 may operate to hold the cord member 220 in position as it passes from one pulley system structure (i.e., heel panel 211, support member 221, cross member 222) to the next and limit how close different pulley system structures can get to one another.

The cord member 220 may define an elongated, continuous line that may be constructed of a rope, strap, tubing, or cable. The cord member may be of an elastic material or a rigid material. In an alternate embodiment, however, the cord member 220 may be a plurality of cord members attached to the rigid shafts 224.

The heel panel 211 may include grommets integral with the apertures through which the cord member 220 passes.

It is contemplated that a user having their foot positioned in the may exert mechanical force on the lower limb therapy device 200 with their upper body (as passive motion) by grabbing either the handles 223 or the cross member 222. In this regard, the lower limb therapy device 200 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 200 is not on a track and can move in any direction, circumduction an available therapy motion option). Indeed, the pulley system enables a user to control the motion and the speed at which the lower limb moves as it is being flexed and extended thru various planes.

Moreover, because of the slider 210 can move on substantially any type of smooth surface, the lower limb therapy device 200 provides a means to support the weight of a user's lower limb and allow the limb to slide and glide even on uneven surfaces as a bed or therapy table.

It is appreciated that in addition to being used for rehabilitation related purposes, the portable lower limb therapy device in accordance with either embodiment can also be used by a user or patient that has limited ability to move or no ability to move their lower limbs (such as someone that is paralyzed from the waist down). For such a user, the portable lower limb therapy device can allow the user to stretch and work the muscles in a leg and/or foot by placing the targeted foot (or foot of the targeted leg) in the portable lower limb therapy device and using force applied solely from the user's arms to lift and position the leg in a manner that causes the muscles in the target foot and/or leg to stretch or otherwise be worked (particularly because the user can move the leg and any direction). Advantageously, such an act can allow the user to improve blood flow in the lower limb and otherwise better maintain the health of the lower limb.

Referring now to FIGS. 11, 12, 13, 14, 15, and 16, a wearable anchor 300 for a therapy device is shown having a support frame 310, a locking component 320, and a securing strap 330. The support frame 310 may define an arcuate body that is sized to be placed on and contour to the thigh of a user and thereby configured to be placed against a user's body. The support frame 310 may be constructed out of hard plastic or other substantially rigid material. It is contemplated, however, that the support frame 310 may alternatively include a hard plastic top layer 311 and a padded bottom layer 312 such that the portion of the support frame 310 that is pressed against a user's thigh is cushioned.

As an arcuate member, it is contemplated that the support frame 310 has a top surface and a bottom surface, with bottom surface being the aspect thereof that is placed against a user's body. Disposed on the top surface of the support frame 310 is a locking component 320. The locking component 320 may include a pair of slot members 321 which extend up vertically from the top surface of the support frame 310, with the slot members 321 attached to one another by a component base 322 which runs horizontally across the top surface of the support frame 310. In such a configuration, the locking component 320 may be attached to the support frame 310 with a single elongated fastener or a plurality of elongated fasteners, such as bolts 323. As the support frame 310 is structured to lay on top a user's thigh with its top surface (and bottom surface) having the same orientation as the user's thigh, such a design results in the slot members 321 being oriented in a manner in which they extend substantially perpendicular to the user's thigh.

Each of the slot members 321 may include a tapered slot in which the cord member 220 of a portable lower limb therapy device 200 of the type discussed with reference to FIGS. 4-10 (or other device that includes cords) may be wrapped around and secured in. In this regard, the slot members 321 with their tapered slots configure the locking mechanism to receive and selectively secure a cord. In such a configuration, the locking component 320 may be attached to the support frame 310 with a single elongated fastener or a plurality of elongated fasteners, such as bolts 323. The tapered slots may be oriented in the slot members 321 such that they extend into the body of the slot member 321 and are substantially parallel to the component base 322 as well as a user's thigh when the wearable anchor 300 is in place on the user.

The securing strap 330 may define an elongated band that includes an attachment mechanism 331, such as corresponding portions of a hook and loop fastener, integral therewith so as to allow one end of the securing strap 330 to releasably attach to another portion thereof. The support frame 310 may additionally include a pair of apertures 313 therein adjacent to each end which are sized to receive the securing strap 330 and allow the securing strap 330 to loop through it. In this regard, by placing the support frame 310 on a user's thigh, looping the securing strap 330 through the apertures 313, and attaching the end of the securing strap 330 to another portion of the securing strap 330, the support frame 310 can be releasably secured to the thigh of a user. Further, the apertures 313 along with the securing strap 330 operate to configure the support frame to be secured to a user's body.

In use, the wearable anchor 300 for a therapy device may be first strapped to patient's thigh. Then patient simply slips the cords from a therapy device, such as the portable lower limb therapy device, in and around the tapered slots of the slot members 321. This action operates to securely fasten the cords from the portable lower limb therapy device in a locked position so that patient can remove hands from the cord. The wearable anchor 300 allows any patient using the portable lower limb therapy device to attain and maintain a static-progressive stretch by a mechanical means rather than a manual means. Presently, in order for patient to engage in static progressive stretching techniques, the patient must manually hold a cord/pulley system in place themselves to attain a static position. The wearable anchor 300, however, will allow patient to engage in a series of static-progressive stretching motions with without ongoing exertion to hold cords. So rather than patient having to hold a fixed static position for several minutes at a time, which can be tiring to the patient's arms, patient now can simply anchor the portable lower limb therapy device cord to the wearable anchor 300 and remove hands from the cord. At this time patient will have achieved a lock of the knee, thus allowing for a static load on the joint.

When appropriate, patient can unlocks the cord wearable anchor 300 and pulls back on cord to create more flexion. This is known as the progressive stretch. After patient creeps the knee a little further into flexion then patient again anchors down the cord, thus creating a new static stretch with greater flexion. All without having to constantly use their hands/arms.

During the healing process after injury or surgery the connective tissue around the joint may shorten or start to form scar tissue which will restrict the knee's range of motion. This will delay patient's rehab efforts and may lead to prolonged complications and loss of quality of life if patient is unable to regain full flexion and or extension of their knee. Static-progressive stretching techniques have been medically proven to breakdown scar tissue and restore full range of motion. When patient engages in static-progressive therapy the scar tissue breaks down and connective tissue is as able to properly stretch out allowing for full range of motion.

Static Progressive therapy works by applying a static force to the joint 3 to 4 times per day for 15 to 20 minute sessions. Static force applied to the joint over time will allow for plastic deformation of connective tissue. This allows for patient to progress in their therapy by engaging in more aggressive knee bends over time, and again applying a load every time they reach a new flexion point. This continues on until full range of motion is achieved. Treatment typically lasts 2 to 4 months. By restoring range of motion in this manner, a patient is able to heal quicker, recapture quality of life and avoid future complications.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A wearable anchor for a therapy device, comprising:

a support frame having opposing side ends and a bottom surface, wherein the support frame is configured to be placed against a body of a user with the bottom surface contact the body of the user;

wherein said support frame includes an elongated aperture adjacent to each side end;

wherein said support frame includes a top surface that is opposite the bottom surface and the locking component is attached to the top surface a locking component integral with said support frame that includes at least one slot sized to receive and selectively secure a cord;

wherein the locking component includes a plurality of slot members that each extend up vertically from the top surface; and wherein the at least one slot extends into each of the plurality of one slot members in a horizontal orientation relative to a portion of the top surface directly below it.

2. The wearable anchor for a therapy device of claim 1, wherein the at least one slot is tapered.

3. The wearable anchor for a therapy device of claim 1, additionally comprising a securing strap that includes an attachment mechanism, wherein said securing strap is integral with each of said apertures and enables the support frame to be secured to the body of the user.

4. The wearable anchor for a therapy device of claim 1, wherein the support frame includes a padded layer.

5. The wearable anchor for a therapy device of claim 1, additionally comprising:

a support base having a platform member attached to and positioned above a slider, wherein the platform member is operative to support a foot of the user that is resting on the platform member and the slider includes a smooth bottom surface which enables the support base to slide on a smooth surface;

wherein the support base includes a proximal edge and a distal edge;

a pulley system defined by a closed force transfer system integral with the support base, wherein said pulley system is integral with the support base at a location adjacent to the proximal edge and at a location adjacent to the distal edge and the pulley system includes at least one system cord; and wherein when said at least one system cord is engaged with the locking component said support base becomes releasably fixed to the support frame at a set distance.

6. A wearable anchor for a therapy device, comprising:

a support frame having opposing side ends and a bottom surface, wherein the support frame is configured to be placed against a body of a user with the bottom surface contact the body of the user;

wherein said support frame includes an elongated aperture adjacent to each side end;

wherein the support frame includes a top surface that is opposite the bottom surface and the locking component is attached to the top surface a securing strap that includes an attachment mechanism, wherein said securing strap is integral with each of said apertures and enables the support frame to be secured to the body of the user;

a locking component integral with said support frame that includes at least one tapered slot sized to receive and selectively secure a cord;

wherein the locking component includes a plurality of slot members that each extend up vertically from the top surface; and wherein the at least one tapered slot extends into each of the plurality of slot members in a horizontal orientation relative to a portion of the top surface directly below it.

7. The wearable anchor for a therapy device of claim 6, additionally comprising:

a support base having a platform member attached to and positioned above a slider, wherein the platform member is operative to support a foot of the user that is resting on the platform member and the slider includes a smooth bottom surface which enables the support base to slide on a smooth surface;

wherein the support base includes a proximal edge and a distal edge;

a pulley system defined by a closed force transfer system integral with the support base, wherein said pulley system is integral with the support base at a location adjacent to the proximal edge and at a location adjacent to the distal edge and the pulley system includes at least one system cord; and wherein when said at least one system cord is engaged with the locking component said support base becomes releasably fixed to the support frame at a set distance.

8. The wearable anchor for a therapy device of claim 6, wherein the support frame includes a padded layer.

* * * * *